US010076002B2

(12) United States Patent
Schlipf

(10) Patent No.: US 10,076,002 B2
(45) Date of Patent: Sep. 11, 2018

(54) ELECTRIC CARTRIDGE TYPE HEATER AND METHOD FOR MANUFACTURING SAME

(71) Applicant: Tuerk & Hillinger GmbH, Tuttlingen (DE)

(72) Inventor: Andreas Schlipf, Tuttlingen (DE)

(73) Assignee: TUERK & HILLINGER GMBH, Tuttlingen (DE)

( * ) Notice: Subject to any disclaimer, the term of this patent is extended or adjusted under 35 U.S.C. 154(b) by 403 days.

(21) Appl. No.: 14/313,204

(22) Filed: Jun. 24, 2014

(65) Prior Publication Data

US 2015/0001206 A1 Jan. 1, 2015

(30) Foreign Application Priority Data

Jun. 26, 2013 (DE) ..... 10 2013 212 205

(51) Int. Cl.

| | |
|---|---|
| ***H05B 3/06*** | (2006.01) |
| ***H05B 3/48*** | (2006.01) |
| ***H05B 3/52*** | (2006.01) |
| ***H05B 3/44*** | (2006.01) |
| ***H01C 1/02*** | (2006.01) |
| ***H01C 3/14*** | (2006.01) |

(52) U.S. Cl.

CPC ..... *H05B 3/44* (2013.01); *H01C 1/02* (2013.01); *H01C 3/14* (2013.01); *H05B 3/06* (2013.01); *Y10T 29/49083* (2015.01); *Y10T 29/49096* (2015.01)

(58) Field of Classification Search

None

See application file for complete search history.

(56) References Cited

U.S. PATENT DOCUMENTS

| | | | | |
|---|---|---|---|---|
| 1,735,831 A * | 11/1929 | Lightfoot | ..... | H05B 3/48 29/447 |
| 2,245,766 A | 6/1941 | Dorfel et al. | | |
| 3,310,769 A * | 3/1967 | Simmons | ..... | H05B 3/48 219/544 |
| 3,512,114 A * | 5/1970 | Dzaack | ..... | H05B 3/48 219/544 |

(Continued)

FOREIGN PATENT DOCUMENTS

| | | |
|---|---|---|
| CN | 102137521 A | 7/2011 |
| CN | 102362545 A | 2/2012 |

(Continued)

*Primary Examiner* — Joseph M Pelham

(74) *Attorney, Agent, or Firm* — McGlew and Tuttle, P.C.

(57) ABSTRACT

An electric cartridge type heater (100, 200, 300, 400, 500, 600, 700, 800, 900, 1000) has at least one the tubular metallic jacket (101, 201, 301, 401, 501, 601, 701, 801, 901, 1001), at least one electric resistance wire (102, 202, 302, 402, 502, 602, 702, 802, 902, 1002) arranged in the interior space of the tubular metallic jacket with two ends for electrically contacting the electric resistance wire, wherein the at least one electric resistance wire is electrically isolated from the tubular metallic jacket by an electrically insulating material (103, 203, 303, 403, 503, 603, 703, 903) arranged in the interior space of the tubular metallic jacket (101, 201, 301, 401, 501, 601, 701, 801, 901, 1001). The electric resistance wire is self-supporting. A method is also provided for manufacturing such an electric cartridge type heater.

20 Claims, 12 Drawing Sheets

(56) References Cited

U.S. PATENT DOCUMENTS 3,678,249 A 7/1972 Lennox
3,890,485 A * 6/1975 Kozbelt ..... G01K 1/14 219/494
3,920,963 A * 11/1975 Beasley ..... G01K 7/04 219/494
4,035,613 A * 7/1977 Sagawa ..... H05B 3/18 219/238
4,300,038 A * 11/1981 Schwarzkopf ..... H05B 3/46 219/523
4,346,287 A * 8/1982 Desloge ..... H05B 3/06 219/541
4,593,182 A * 6/1986 Schwarzkopf ..... H05B 3/48 219/523
4,621,251 A * 11/1986 Keefe ..... H05B 3/46 219/236
5,136,143 A * 8/1992 Kutner ..... H05B 3/46 219/523
5,247,158 A * 9/1993 Steinhauser ..... H05B 3/46 219/534
6,172,345 B1 * 1/2001 Dial ..... H05B 3/44 219/544
6,191,400 B1 * 2/2001 Cunningham ..... H05B 3/48 219/543
2004/0211771 A1 * 10/2004 Crandell ..... H05B 3/44 219/544
2007/0023418 A1 * 2/2007 Schlipf ..... H05B 3/04 219/532
2008/0290085 A1 * 11/2008 Schlipf ..... H05B 3/06 219/526
2010/0147826 A1 * 6/2010 Schlipf ..... H05B 3/48 219/481
2011/0056931 A1 * 3/2011 Schlipf ..... B29C 45/2737 219/548
2011/0180529 A1 * 7/2011 Schlipf ..... H05B 3/48 219/534
2016/0014844 A1 * 1/2016 Schlipf ..... H05B 3/0014 219/544

FOREIGN PATENT DOCUMENTS

CN 202258509 U 5/2012
DE 12 69 749 B 6/1968
DE 20 42 405 A1 3/1972
DE 28 56 444 A1 7/1980
DE 20 2005 011 686 U1 10/2005
EP 0 771 773 A2 5/1997

* cited by examiner 105
112a
112b
102b
102a
104
101
103
106
102
100

112a
112b
102b
102a
104
102
110

112a
112b
102b
104
102
120

305
312a
308
301
303
304
302a
307
309

300
312a
312b
302b
308
304
302a 310
309
307
302

ELECTRIC CARTRIDGE TYPE HEATER AND METHOD FOR MANUFACTURING SAME

CROSS REFERENCE TO RELATED APPLICATIONS

This application claims the benefit of priority under 35 U.S.C. § 119 of German Patent Application DE 10 2013 212 205.5 filed Jun. 26, 2013, the entire contents of which are incorporated herein by reference.

FIELD OF THE INVENTION

The present invention pertains to an electric cartridge type heater having least one first tubular metallic jacket, at least one resistance wire, which produces heat if an electrical current passes through the resistance wire, arranged in the interior of the first tubular metallic jacket, with two ends for electrically contacting the resistance wire, wherein the at least one resistance wire is electrically insulated from the first tubular metallic jacket by an electrically insulating material arranged in the interior of the first tubular metallic jacket, and the present invention further pertains to a method for manufacturing an electric cartridge type heater.

BACKGROUND OF THE INVENTION

Electric cartridge type heaters have been known for many years. They usually have at least one metallic jacket, in the interior space of which at least one resistance wire is arranged, wherein an undesired electric contact between the resistance wire and the metallic jacket is prevented by the space between the metallic jacket and the resistance wire being filled at least partially with an electrically insulating material having good thermal conductivity, e.g., magnesium oxide. Electric cartridge type heaters also comprise, in particular, variants with an inner metallic jacket and an outer metallic jacket, often in the form of concentrically arranged tubes, between which the at least one resistance wire is arranged, so that an electric cartridge type heater designed in this manner can be pushed over an object to be heated.

It should be noted, furthermore, that an electric ballast resistor has a design identical to that of an electric cartridge type heater and an electric ballast resistor therefore also represents an electric cartridge type heater in the sense of this invention.

Different embodiments of such electric cartridge type heaters are known, in principle, especially those in which the electric contacting takes place from both sides, and those in which the electric contacting takes place from one side.

Electric cartridge type heaters have hitherto been manufactured mainly according to two different methods.

The Oakley principle is frequently used especially in electric cartridge type heaters in which the electric contacting takes place from both sides. The resistance wire, which is usually coiled tightly, pulled forward or sometimes also prestressed, is inserted into the jacket tube and clamped with its ends in pulling rods, so that the individual coils of the resistance wire are brought to spaced locations from one another. A filling tube is now pushed within the jacket tube over the resistance wire, which ensures that there can be no electric contact between the resistance wire and the jacket tube. When the usually powdered or granular electrically insulating material is filling in, the filling tube can then be pulled out of the jacket tube slowly while shaking, which causes the powdered or granular electrically insulating material to fill the volume released by the filling tube during pulling in just as the space between the coils, so that a sufficient insulation resistance and high-voltage resistance is guaranteed between the resistance wire and the metallic jacket or between two coils of the resistance wire.

The direct application of this principle is not possible in case of electric cartridge type heaters in which the electric contacting is to take place from one side, only because it presupposes that the resistance wire can be mechanically stressed during the filling of the electric cartridge type heater with the insulating material. This applies to high-performance cartridge type heaters, in which high power densities must be reached, so that very short distances from the outer wall and very small coil pitches are important.

To guarantee the desired course of the resistance wire, a carrier structure is therefore used, which provides the opposing forces to the acting mechanical stress, for example, in the form of a coil body usually manufactured from ceramic, or a carrier structure is used, which holds the end of the resistance wire located farthest away from the connection side, so that a mechanical stress, e.g., due to pulling rods, can be built up against this holding point, which stress is necessary to produce a coil structure coiled with spaces and to maintain the coils at spaced locations from one another, i.e., to avoid variations in spacing or short circuits between the individual coils.

However, it is seen in practice that the arrangement of the resistance wire on a coil body or such a carrier structure entails a great effort in terms of manufacturing technology and is susceptible to problems and is expensive.

These problems can be explained especially well for the case in which low-ohmic resistors must be obtained for the application for which the electric cartridge type heater is intended, which is frequently the case in case of relatively long electric cartridge type heaters.

In principle, a lower resistance is known to be able to be achieved by increasing the cross section of the hot wire. However, this leads not only to problems if a reduced space is required for construction, but also to stronger forces to be applied when feeding and removing the coil body into and from the coiling machine and when inserting and tightening the resistance wire in the hole of the coil body, which may even lead to breakage of the coil body in case of porous ceramic coil bodies and if automated coiling is employed, it reduces the speed with which the coiling machine can be operated and thus lowers the output or requires the simultaneous use of a larger number of expensive coil body coiling machines.

As an alternative, it is possible to change over to resistance wires with a lower resistivity, for example, by using CuNi44 instead of NiCr8020. However, this massively reduces the service life of the electric cartridge type heaters and the loadability of the ballast resistors.

The consequence of these problems in practice is usually that several individual resistors with higher resistance values coiled on coil bodies are manufactured and connected in parallel to achieve lower resistances in order to make it possible to avoid compromises in terms of both the cross section and the resistivity of the resistance wire. However, this also leads to a great effort, because a larger number of electric contact points must be provided and centering pieces must often be provided between the coil bodies to guarantee accurate positioning. In addition, any additional electric contact implies an additional risk of the electric cartridge type heater not functioning corresponding to the specifications, especially in case of low-voltage applications, because even low contact resistances may lead to interruptions.

SUMMARY OF THE INVENTION

An object of the present invention is therefore to provide an improved, especially more reliable, simpler and more cost-effective electric cartridge type heater and a method for manufacturing same.

The electric cartridge type heater according to the present invention has at least one tubular metallic jacket and at least one electric resistance wire arranged in the interior space of the tube that is enclosed by this metallic jacket with two ends for electrically contacting the electric resistance wire. The at least one electric resistance wire is electrically insulated from the tubular metallic jacket by an electrically insulating material arranged in the interior of the tubular metallic jacket. The two ends of the at least one electric resistance wire or electric connection means, which are in electric connection with the two ends of the at least one electric resistance wire, or one end of the electric resistance wire and a connection means, which is in electric connection with the other end of the electric resistance wire, may be lead out of the metallic jacket on the same side of said tubular metallic jacket, but a bilateral contacting, led out radially or tangentially, also likewise possible as well, especially also in the middle of the cartridge type heater. Such connection means may be designed, e.g., as a connecting wire, connecting tube, pigtail or connecting bolt, which are soldered, welded or pressed to the end of the electric resistance wire.

It is a feature according to the present invention that the electric resistance wire is self-supporting. The word "self-supporting" means here at least that the minimum distances from one coil to the next are guaranteed by the internal stress, but no mechanical stresses of the resistance wire are preferably provided or maintained by further components of the electric cartridge type heater in the installed state in the cartridge type heater and, in particular, no carrier structure has to be present for absorbing such stresses.

Whether or not an electric resistance wire is self-supporting in the above-mentioned preferred sense can be checked simply by determining whether the course and/or shape of the resistance wire changes when the cartridge type heater is removed and especially the insulating material surrounding the resistance and a carrier structure that may possibly be present are removed or destroyed. It appears from this that the term "dimensionally stable" more accurately "dimensionally stable in case of removal of the resistance wire from the cartridge type heater" could also be used alternatively to the term "self-supporting." The electric resistance wire is thus provided in a preformed state and already brought to the desired shape without carrier structure.

It should be noted, in particular, that these conditions are also met even if the resistance wire was re-stressed in the built-in state.

It becomes possible with the embodiment of the resistance wire, according to the present invention, to achieve a marked improvement of the attainable tolerances concerning cylindrical shape, coaxiality, concentricity, which may be especially below 1 mm and preferably below 0.5 mm, for coiled heat resistance wires.

The use of a self-supporting resistance wire makes it possible to simply insert the preformed resistance wire brought to the desired shape into the jacket tube during the manufacture and to surround it with insulating material, which simplifies the manufacturing process and leads to significant cost savings. Rejects due to breakage of the angle body and possibly loss of time due to a possible reduction of the speed of coiling to avoid such breakage are reliably avoided.

Further advantages are that the self-supporting resistance wire makes it possible in a reliable manner to carry out coiling with very small pitches or very short distances between the coils and to reliably offer a short distance between the resistance wire and the tubular metallic jacket. Both are essential for the best possible heat transport to the tubular metallic jacket and a low surface load of the resistance wire.

To increase the reliability of the process during the manufacture of the electric cartridge type heater, it is advantageous for at least one positioning element to be provided, optionally under axial stress or axial pressure on the heating coil, for fixing the position of the resistance wire in a defined manner in the interior of the tubular metallic jacket. In particular, the desired distance between the heating element and the tubular metallic jacket can thus be set accurately. It thus becomes possible, especially in case of coiled resistance wires, that the distance between the electric resistance wire and the tubular metallic jacket is smaller than 1.5 mm and especially smaller than 1 mm.

A second tubular metallic jacket is arranged concentrically to the first tubular metallic jacket in the interior space of the latter in an advantageous embodiment of the present invention, so that the self-supporting electric resistance wire is arranged between the first and second tubular metallic jackets. A cartridge type heater that can enclose a component to be heated can thus be provided.

It should be noted, in particular, that hollow cartridges of a corresponding design with inner metallic jacket and outer metallic jacket, which may also be made in one piece with a bottom connecting them, or ballast resistors having this design can also be considered to be an electric cartridge type heater in the sense of the present invention.

In a variant of the electric hollow cartridge thus manufactured, the second tubular metallic jacket has a contoured interior space, i.e., the diameter of the interior space varies in the radial direction, i.e., in a direction at right angles to the direction in which the second tubular metallic jacket extends. An accurately fitting or an at least more accurately fitting enclosing of the component to be heated can be made possible hereby in many cases.

A variant of the present invention that is especially advantageous for hollow cartridges is one in which an electrically insulating material having a thermal conductivity that is worse than the thermal conductivity between the self-supporting electric resistance wire and the tubular metallic jacket is arranged between the first tubular metallic jacket and the self-supporting electric resistance wire. The heat generated shall be preferably removed in the direction of the interior space of the hollow cartridge in electric hollow cartridges in order to heat the component to be heated, over which the hollow cartridge is pushed, which is achieved by this measure.

In a preferred variant of the present invention, the electric cartridge type heater has at least one spacer, which makes it possible to arrange the resistance wire in the tubular metallic jacket in a reproducible manner. In particular, the resistance wire may be arranged such that is coiled around this, because it is possible to push the spacer into the self-supporting resistance wire in a controlled manner after the resistance wire has been formed. Contrary to the carrier structures of usual resistance wire, such a spacer has no structure with which a mechanical stress of the resistance wire is maintained. It is, of course, also possible as an alternative or in addition to provide spacers to a second tubular metallic jacket that may possibly be provided.

It is advantageous, furthermore, if the spacer has a hole, through which the resistance wire is led, because an unintended contact between different sections of the resistance wire is avoided hereby.

Another advantage of the electric cartridge type heater according to the present invention is that depending on the application, a plurality of different embodiments of the course of the resistance wire are possible, which can otherwise often be embodied with very great difficulty only.

A geometric arrangement of the resistance wire makes provisions for the resistance wire to have a section leading away from the connection-side end face of the electric cartridge type heater and a section that is conductively connected with that section and leads back to the connection-side end face, wherein these sections of the resistance wire are designed such that they are coiled around one another.

Another possible geometric arrangement of the resistance wire is designed such that the resistance wire extends in a coiled form and that one end of the resistance wire of a section of the electric connection means extends in the space enclosed by the coils to the connection-side end face of the electric cartridge type heater.

As an alternative hereto, the first, outer metallic jacket may also be used as a return conductor in some applications if one end of the self-supporting resistance wire is connected, preferably inside, with the first, outer metallic jacket.

Finally, a bifilar coiling of the self-supporting resistance wire is also possible, which may be advantageous when the lowest possible inductivity of the arrangement is desired.

It is possible in coiled resistance wire that the resistance wire has different coil pitches to provide different power densities.

It becomes possible with the self-supporting resistance wire according to the present invention that the pitch of the resistance wire corresponds to a maximum of 3 times the diameter of the resistance wire, especially to 2.5 times and preferably to 2 times the diameter of the resistance wire in the area coiled to the smallest pitch.

Finally, a meandering course of the resistance wire may be provided as well.

One possible distinctive feature from prior-art electric cartridge type heaters with coil bodies, on which the heating element is coiled under mechanical stress, is that the two ends of the electric resistance wire point in the same direction.

It is advantageous in all exemplary embodiments discussed above if the entire structure is compacted, especially compacted by reducing the cross section.

It is preferable, furthermore, that the cross section of the self-supporting electric resistance wire has a smaller extension when viewed in the axial direction of the cartridge type heater than when viewed in the axial direction of the cartridge type heater. A resistance wire that is approximated to the geometry of flat wires that cannot otherwise be used for this application is thus provided.

The method according to the present invention for manufacturing an electric cartridge type heater has at least the following steps: Provision of at least a first tubular metallic jacket; deformation of a self-supporting resistance wire, so that it describes a preset curve in the space in a dimensionally stable manner, which said curve is arranged in an interior space of the first tubular metallic jacket; arrangement of the deformed self-supporting resistance wire in the interior space of the first tubular metallic jacket; and embedding of the deformed self-supporting resistance wire in at least one electrically insulating material, so that an electric contact is avoided between sections of the preset curve in the space, which curve is described by the preformed self-supporting resistance wire, and both other sections of the deformed self-supporting resistance wire and the first tubular metallic jacket and further metallic jackets, if present.

The sequence of the steps is variable especially in respect to the first two steps.

The deformation of the self-supporting resistance wire can be achieved concretely, for example, by the self-supporting resistance wire being coiled on a mandrel. However, other common manufacturing methods for manufacturing springs may generally be considered as well for bringing about the desired deformation.

Provisions are made in an especially advantageous variant of the method for changing the cross section of the self-supporting resistance wire by pressing, especially making thinner in directions that correspond to a radial direction of the metallic jacket after insertion into the tubular metallic jacket, after the deformation of the self-supporting resistance wire to the preset curve in the space, preferably before the deformed self-supporting resistance wire is arranged in the interior space of the first tubular metallic jacket. The structural shape can be made especially compact in this manner.

It is especially preferred to provide a second tubular metallic jacket and to arrange it concentrically to the first tubular metallic jacket in the interior space of the first tubular metallic jacket and, furthermore, to arrange it within the three-dimensional curve described by the self-supporting resistance wire, so that the second metallic jacket is surrounded by at least one section of the self-supporting resistance wire when viewed in any radial direction of the metallic jacket, so that an electric hollow cartridge is produced. In particular, the second metallic jacket may be connected with the first metallic jacket, either via a bottom disk to be fitted separately or also via a direct connection, which may also be made in one piece, and it is especially also possible and advantageous to form the outer metallic jacket, inner metallic jacket and bottom piece from one piece of metal.

The product manufactured with the method is further improved by an arrangement comprising at least the first tubular metallic jacket, the second tubular metallic jacket and the self-supporting resistance wire arranged therein being arranged on a contoured mandrel and pressed radially, so that at least the diameter of the interior space of the second tubular metallic jacket will vary over the extension thereof. In particular, a conical or stepped course of the interior space of the second tubular metallic jacket can thus be embodied. A possibility can be created in this manner for also heating a component with a more complex surface shape with an accurately fitting hollow cartridge.

The present invention will be explained in more detail below on the basis of figures, which show different exemplary embodiments of the present invention. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figures 1A, 1B, 1C:
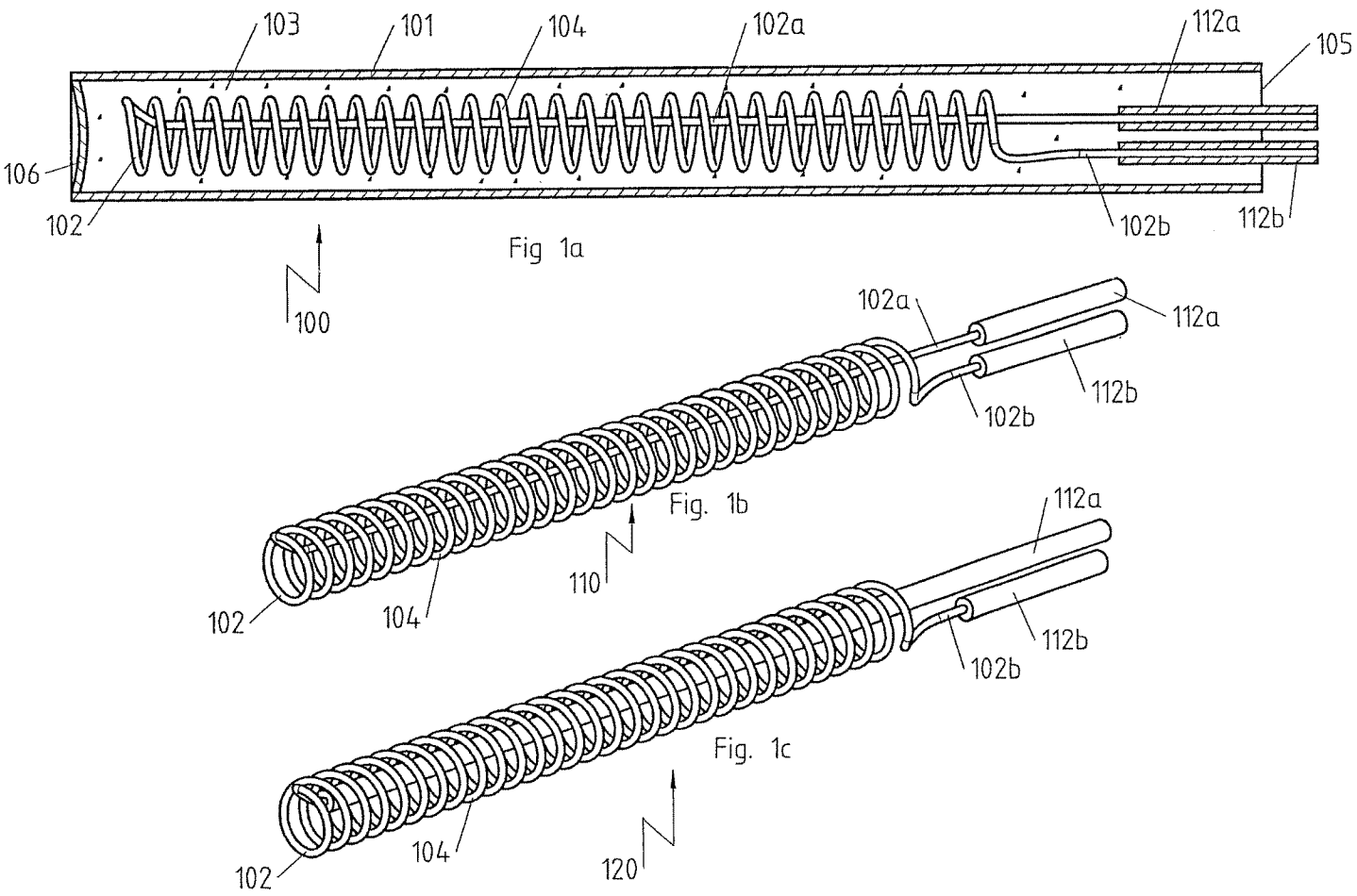
FIG. 1*a* is sectional view showing a first exemplary embodiment of an electric cartridge type heater with the metallic jacket cut open and with the electrically insulating material partially removed.
FIG. 1*b* is a perspective view showing a resistance wire assembly unit of the exemplary embodiment from FIG. 1*a;*
FIG. 1*c* is a perspective view showing a variant of the resistance wire assembly unit, which can be used in the exemplary embodiment from FIG. 1*a;*

Referring to the drawings in particular, identical components of identical exemplary embodiments are designated by identical reference numbers in all figures. The features illustrated on the basis of individual embodiments can be applied to all other embodiments unless they are in direct conflict with one another.

FIG. 1*a* shows an electric cartridge type heater 100 with a first tubular metallic jacket 101 and with a self-supporting electric resistance wire (heat conductor) 102 arranged in the interior tubular space of the first tubular metallic jacket 101 with two ends 102*a*, 102*b* for electrically contacting the self-supporting electric resistance wire 102. The self-supporting electric resistance wire 102 is electrically insulated from the first tubular metallic jacket 101 by an electrically insulating material 103, e.g., magnesium oxide, arranged in the interior space of the first tubular metallic jacket 101. The two ends 102*a*, 102*b* of the at least one self-supporting electric resistance wire 102 are received in connecting bolts 112*a*, 112*b* and are pressed to same. The connecting bolts 112*a*, 112*b* are led out of the first tubular metallic jacket 101 on the same side of said metallic jacket, namely, on the end face 105 thereof. A bottom 106, which closes the metallic jacket 101 on the connection-side end face 105, is located opposite that side.

As is best recognized in the view of the resistance wire assembly unit 110 in FIG. 1*b*, the self-supporting resistance wire 102 extends in a coiled form and the end 102*a* of the resistance wire 102 extends in the space enclosed by the coils 104 in the direction of the connection-side end face 105 of the electric cartridge type heater 100. The electric resistance wire 102 shown in FIG. 1*b* is self-supporting, i.e., it only needs to be inserted into the interior space defined by the tubular jacket surface 101 for installation in the electric cartridge type heater 100.

The possibility shown in FIG. 1*c* is pointed out, in particular, according to which the connecting bolt 112*a* can be designed in the resistance wire assembly unit 110 such that the contact is established at the end 102*a* of the resistance wire 102 in the space enclosed by the coils 104, so that a section of the connecting bolt 112*a* extends in this space. It is possible as a result to reduce the resistance of the electric return.

Figure 2A:
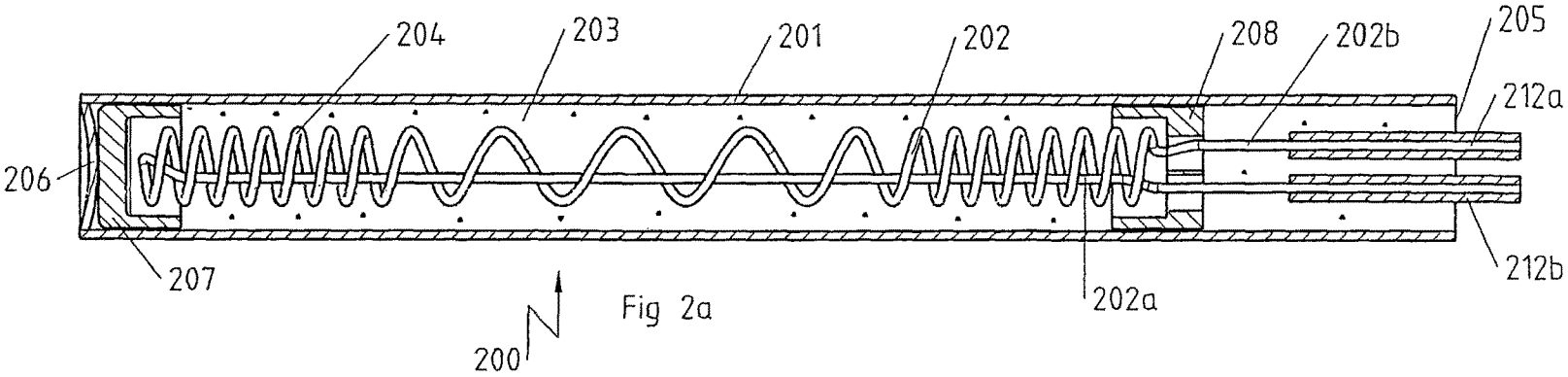
FIG. 2*a* is sectional view showing a second exemplary embodiment of an electric cartridge type heater with the metallic jacket cut open and with the electrically insulating material partially removed.
Figure 2B:
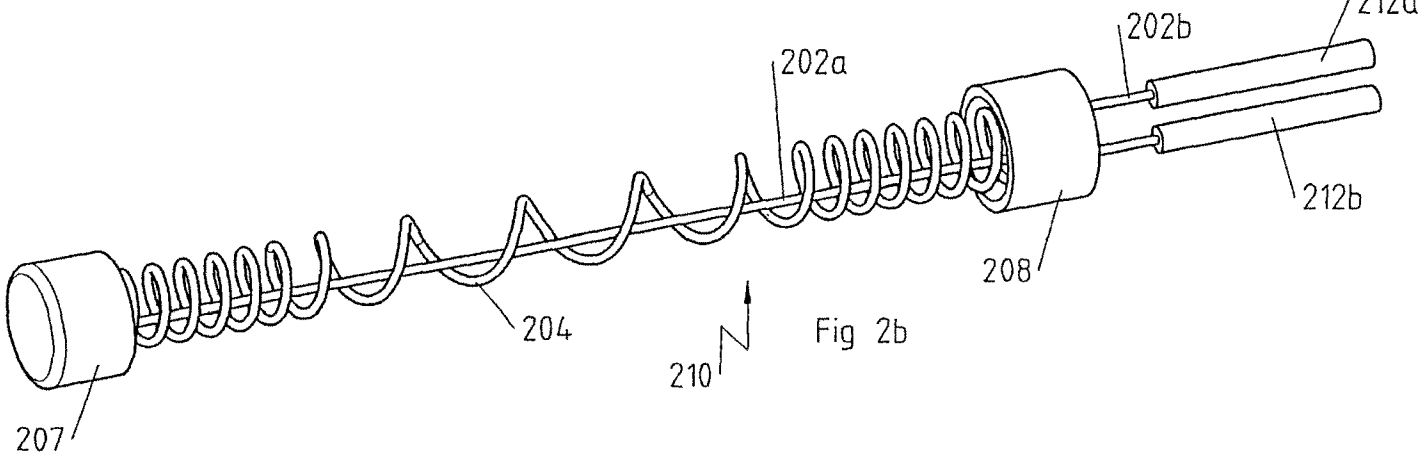
FIG. 2*b* is a perspective view showing the resistance wire assembly unit of the exemplary embodiment from FIG. 2*a;*

The embodiment of the electric cartridge type heater 200 according to FIGS. 2*a* and 2*b* differs from the embodiment according to FIGS. 1*a* and 1*b* in that the resistance wire assembly unit 210 shown in FIG. 2*b* also has two positioning elements 207, 208, which guarantees the reproducible arrangement of the resistance wire assembly unit 210 in the metallic jacket 201. Further, a locally different heat output is achieved due to the variation of the coil pitches.

Figures 3A, 3B:
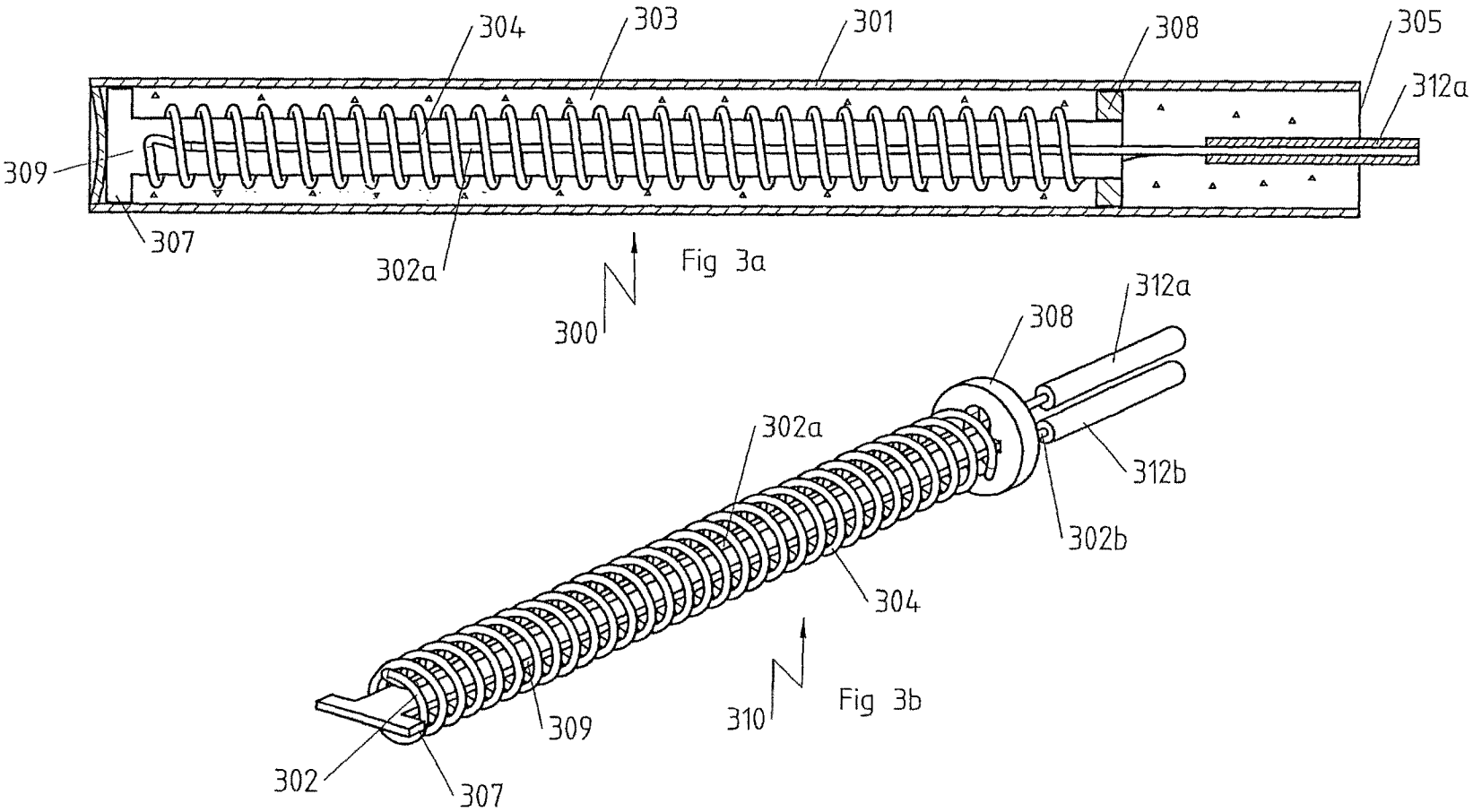
FIG. 3*a* is sectional view showing a third exemplary embodiment of an electric cartridge type heater with the metallic jacket cut open and with the electrically insulating material partially removed.
FIG. 3*b* is a perspective view showing the resistance wire assembly unit according to the exemplary embodiment from FIG. 3*a;*

An embodiment of the electric cartridge type heater 300 according to FIGS. 3*a* and 3*b* differs from the embodiment according to FIGS. 2*a* and 2*b* only in that the resistance wire assembly unit 310 shown in FIG. 3*b* has a positioning element 307, which is arranged at a spacer 309, which extends through the self-supporting resistance wire 302 and is designed as a rigid carrier. This makes it possible to improve the reproducibility of the assembly, not only in respect to the radial position of the self-supporting resistance wire 302, but also in respect to the longitudinal position of said resistance wire, i.e., the question of how far the self-supporting resistance wire 302 is to be pushed into the first tubular metallic jacket 301.

Figure 4A:
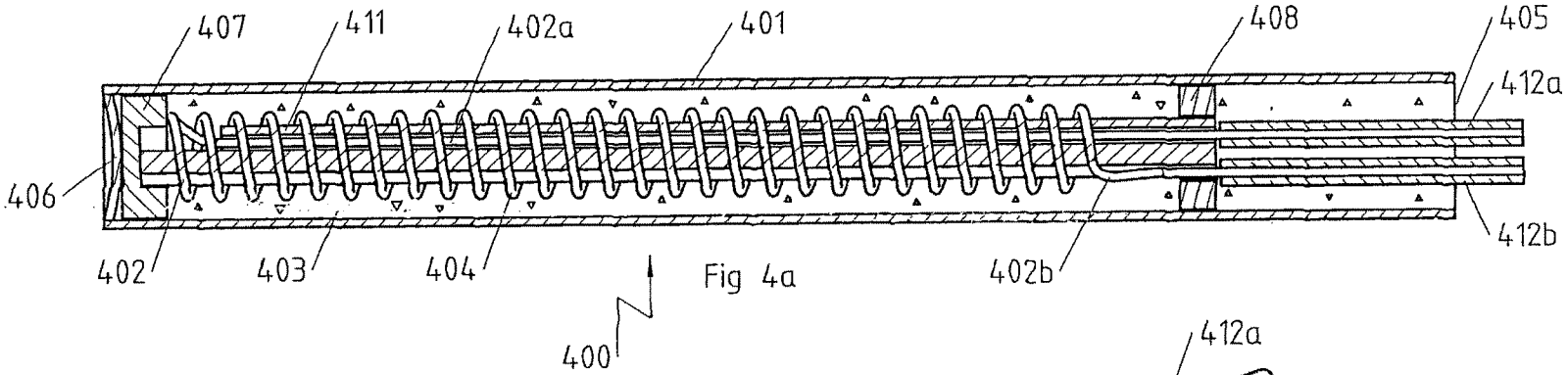
FIG. 4*a* is sectional view showing a fourth exemplary embodiment of an electric cartridge type heater with the metallic jacket cut open and with the electrically insulating material partially removed.
Figure 4B:
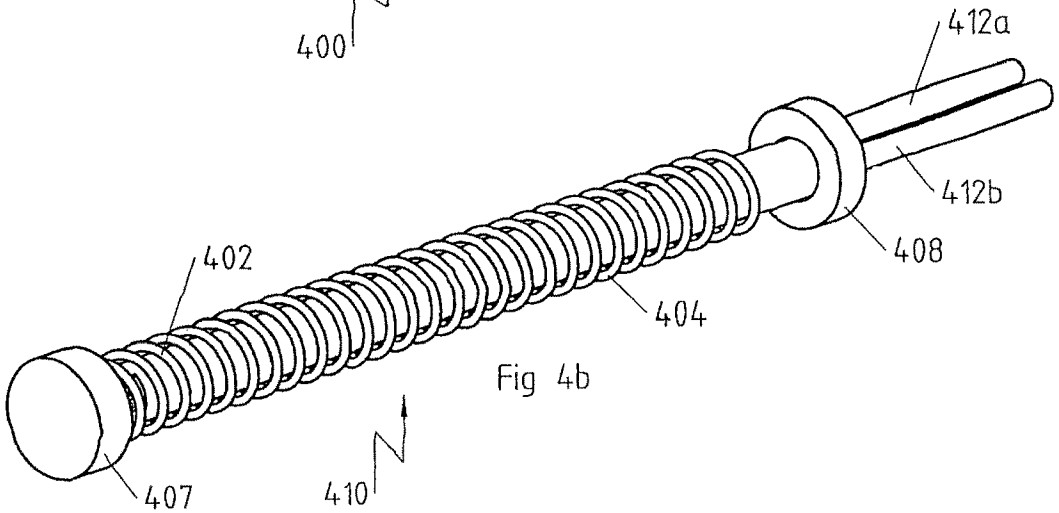
FIG. 4*b* is a perspective view showing the resistance wire assembly unit according to the exemplary embodiment from FIG. 4*a;*

The embodiment of the electric cartridge type heater 400 according to FIGS. 4*a* and 4*b* differs from the embodiment according to FIGS. 3*a* and 3*b* only in that the spacer 409 has a hole 411, through which the end 402*a* of the self-supporting resistance wire 402 extends in the space enclosed by the coils 404 to the connection-side end face 405 of the electric cartridge type heater, so that an undesired contact of the end 402*a* with another part of the self-supporting electric resistance wire 402 is prevented from occurring with certainty.

Figure 5A:
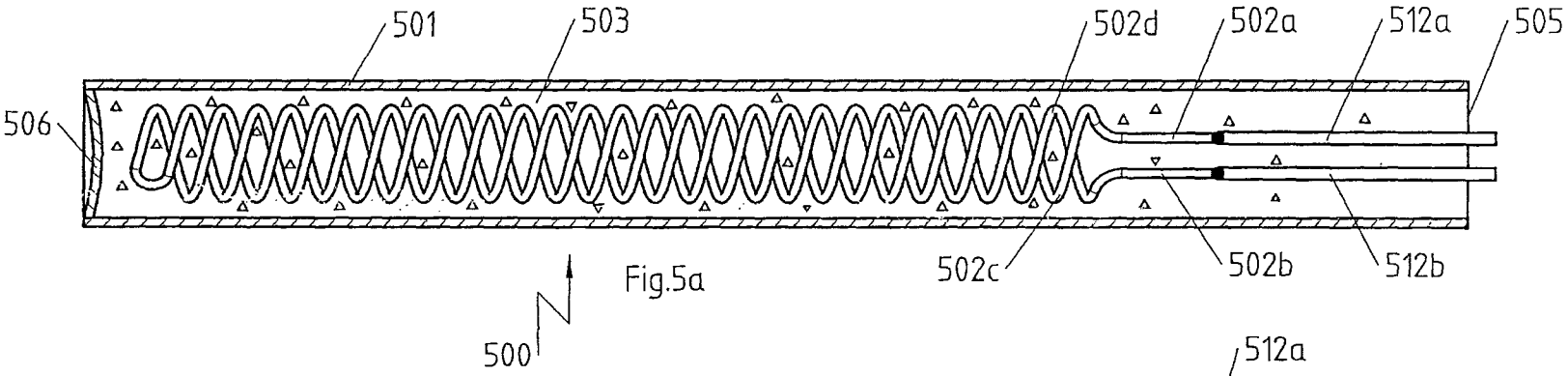
FIG. 5*a* is sectional view showing a fifth exemplary embodiment of an electric cartridge type heater with the metallic jacket cut open and with the electrically insulating material partially removed.
Figure 5B:
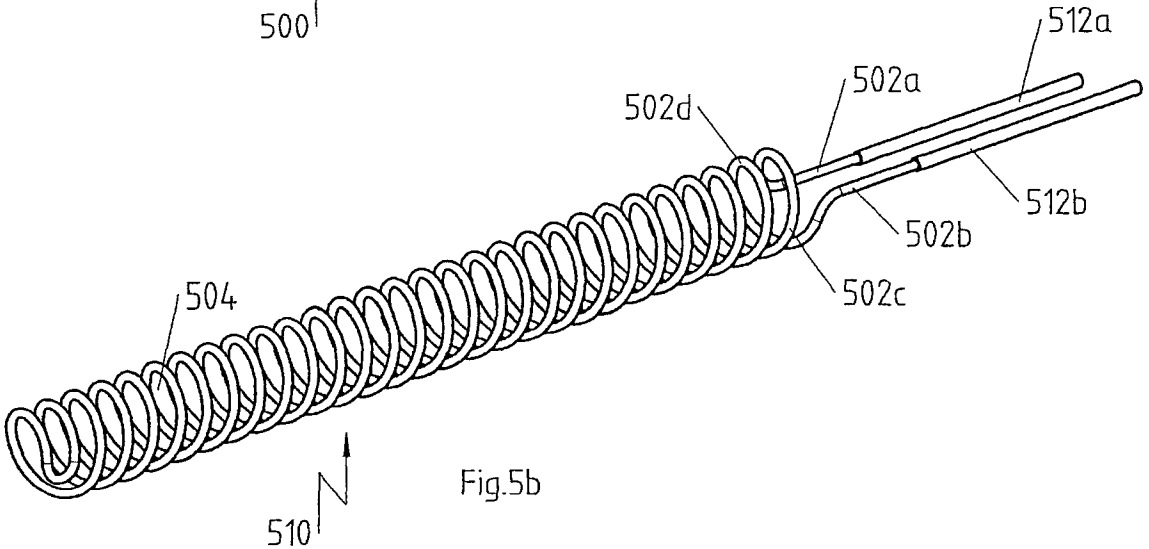
FIG. 5*b* is a perspective view the resistance wire assembly unit according to the exemplary embodiment shown in FIG. 5*a;*

The embodiment of the electric cartridge type heater 500 according to FIGS. 5*a* and 5*b* differs from the embodiment according to FIGS. 1*a* and 1*b* only in that, as can be best recognized in FIG. 5*b*, the ends 502*a* and 502*b* of the self-supporting resistance wire 502 are soldered to connection wires 512*a*, 512*b* and that the self-supporting resistance wire 502 has a section 502*c* leading away from the connection-side end face 505 of the electric cartridge type heater 500 and a section 502*d*, which is connected with that section in an electrically conducting manner and leads back to the connection-side end face 505, and these sections of the self-supporting resistance wire 502 are coiled one around the other, i.e., they have a bifilarly coiled design.

Figure 5C:
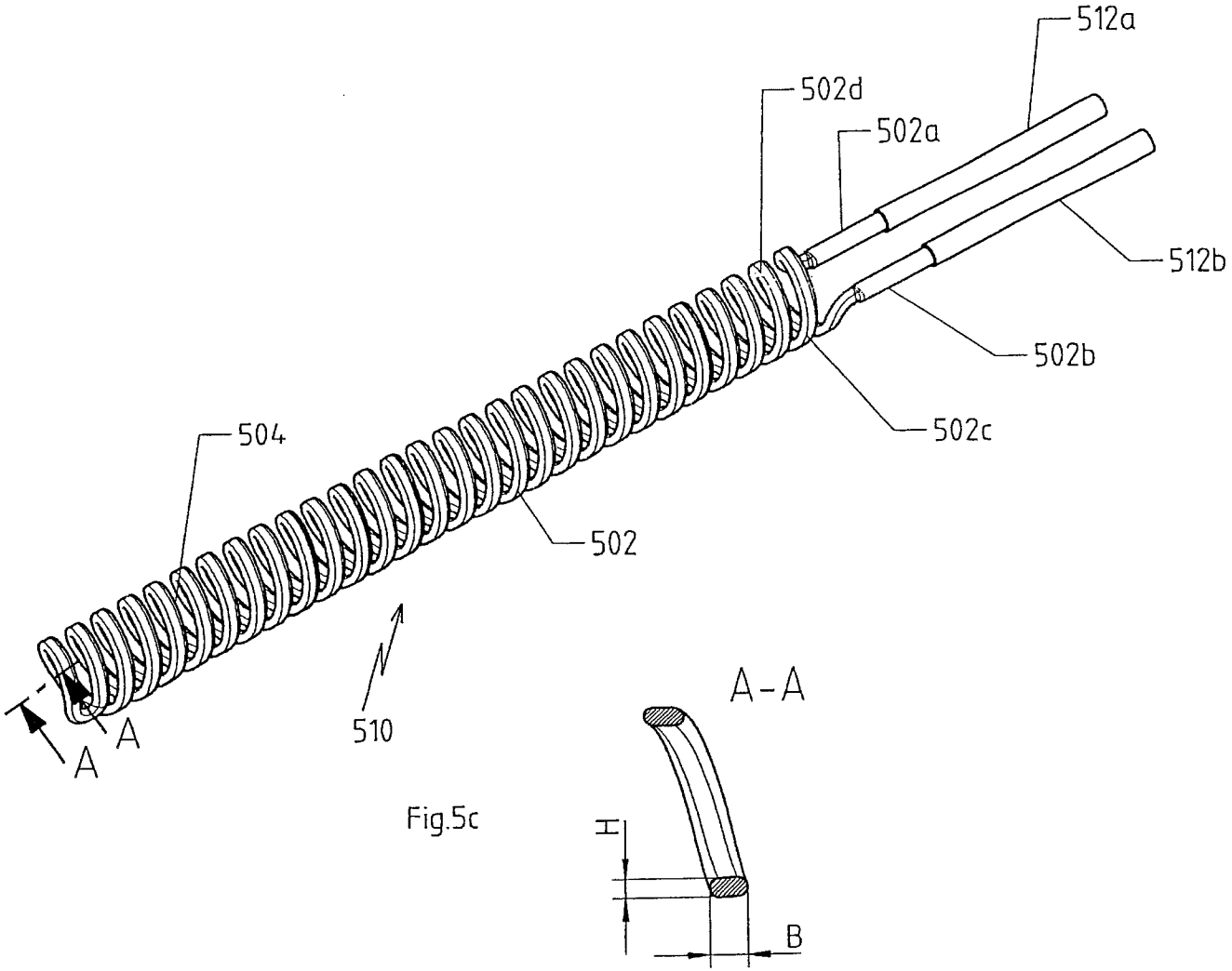
FIG. 5*c* is a perspective view a variant of the resistance wire assembly unit according to the exemplary embodiment shown in FIG. 5*a;*

FIG. 5*c* shows a variant of the resistance wire assembly unit according to the exemplary embodiment shown in FIG. 5*a*, in which a further change was brought about in the cross section of the resistance wire 502 after the deformation of the self-supporting resistance wire 502 into the resistance wire assembly unit shown in FIG. 5*b*. This is possible, for example, by a rod or a mandrel being pushed into the interior of the resistance wire coils, whose diameter essentially corresponds to the coil diameter, and by subsequently performing a radial pressing. The cross section of the resistance wire 502 is transformed hereby from a round to an oval shape, as a result of which a more compact structural shape becomes possible, in particular.

Figure 6A:
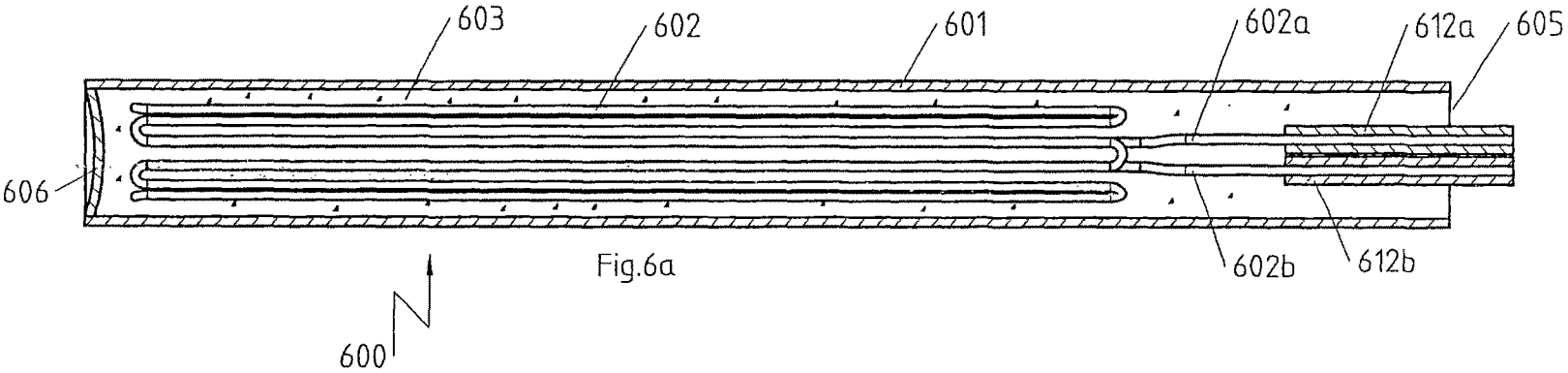
FIG. 6*a* is sectional view showing a sixth exemplary embodiment of an electric cartridge type heater with the metallic jacket cut open and with the electrically insulating material partially removed.
Figure 6B:
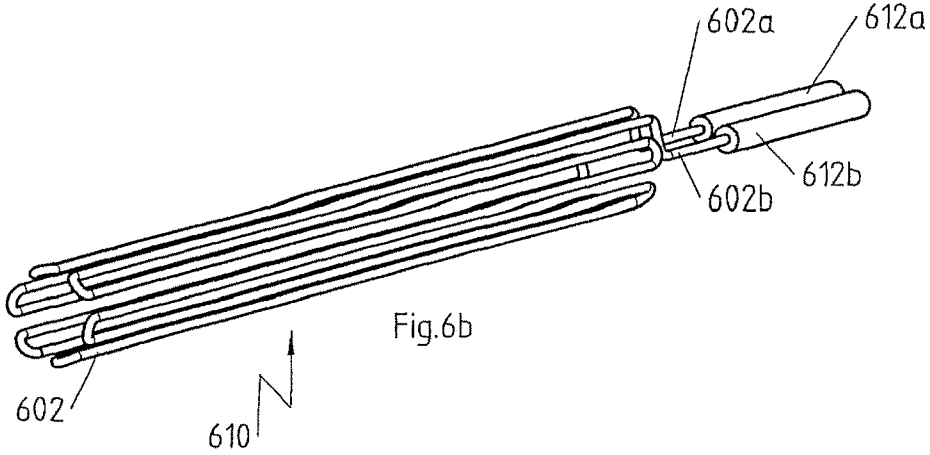
FIG. 6*b* is a perspective view the resistance wire assembly unit according to the exemplary embodiment shown in FIG. 6*a;*

The embodiment of the electric cartridge type heater 600 according to FIGS. 6*a* and 6*b* differs from the embodiment according to FIGS. 1*a* and 1*b* only in that the resistance wire assembly unit 610 shown in FIG. 6*b* has a meandering self-supporting electric resistance wire 602.

Figure 7A:
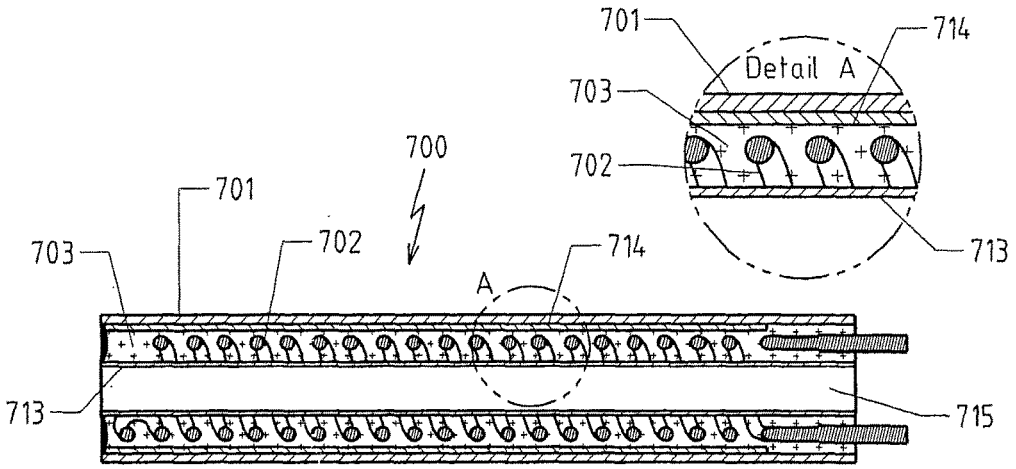
FIG. 7*a* is sectional view showing a seventh exemplary embodiment of an electric cartridge type heater, viewed in the cross section along the direction in which the electric cartridge type heater extends.

The electric cartridge type heater 700 according to FIG. 7*a* differs from the electric cartridge type heater 500 according to FIG. 5*a* above all in that a second, inner tubular metallic jacket 713 is provided, which is arranged concentrically to the first tubular metallic jacket 701 in the interior of the bifilarly coiled self-supporting resistance wire 702, so that a hollow cartridge is formed. Another difference is that a layer 714 consisting of electrically insulating material having a thermal conductivity that is worse than that of the filling material 703, which material contributes to the heat being dissipated preferably in the direction of the interior space 715 of the second, inner tubular metallic jacket 713, is arranged between the first, outer tubular metallic jacket 701 and the bifilarly coiled self-supporting resistance wire 702.

Figure 7B:
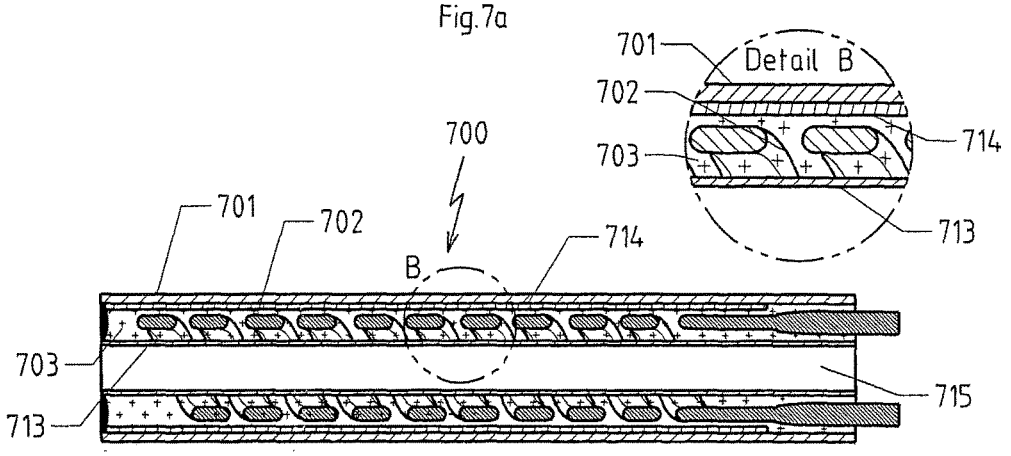
FIG. 7*b* is sectional view showing the exemplary embodiment from FIG. 7*a* after an additional pressing step.
Figure 7C:
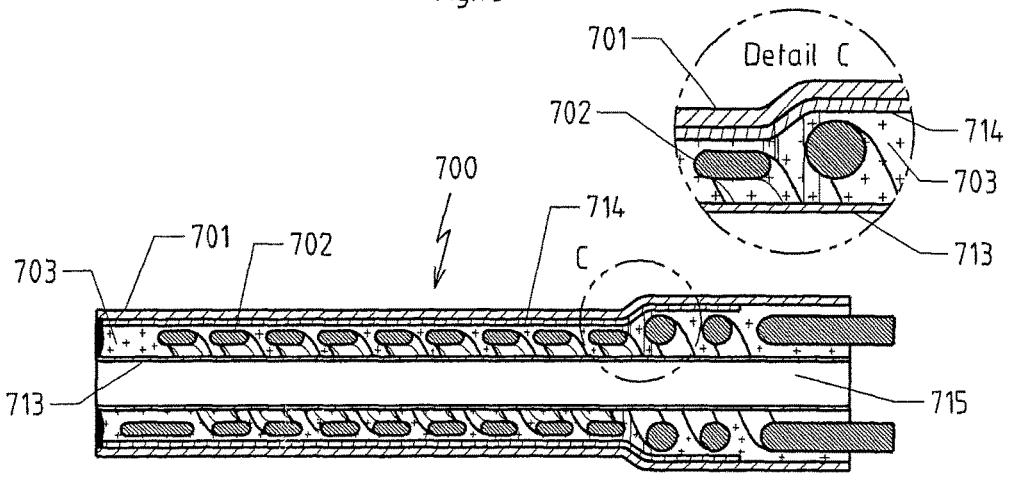
FIG. 7*c* is sectional view showing the exemplary embodiment from FIG. 7*a* after an alternative additional pressing step.

The embodiments of the electric cartridge type heater 700 shown in FIGS. 7*b* and 7*c* are obtained by radial pressing over the entire length of the cartridge type heater 700 (as is shown in FIG. 7*b*) or over a part of the length of the cartridge type heater (as is shown in FIG. 7*c*). It becomes clear especially when comparing the respective detail views A, B and C belonging to the figures with one another that a deformation of the self-supporting resistance wire 702 is also possible in this step as an alternative or in addition to a deformation of the self-supporting resistance wire 702 before they are inserted into the first, outer tubular metallic jacket 701.

Figure 8:
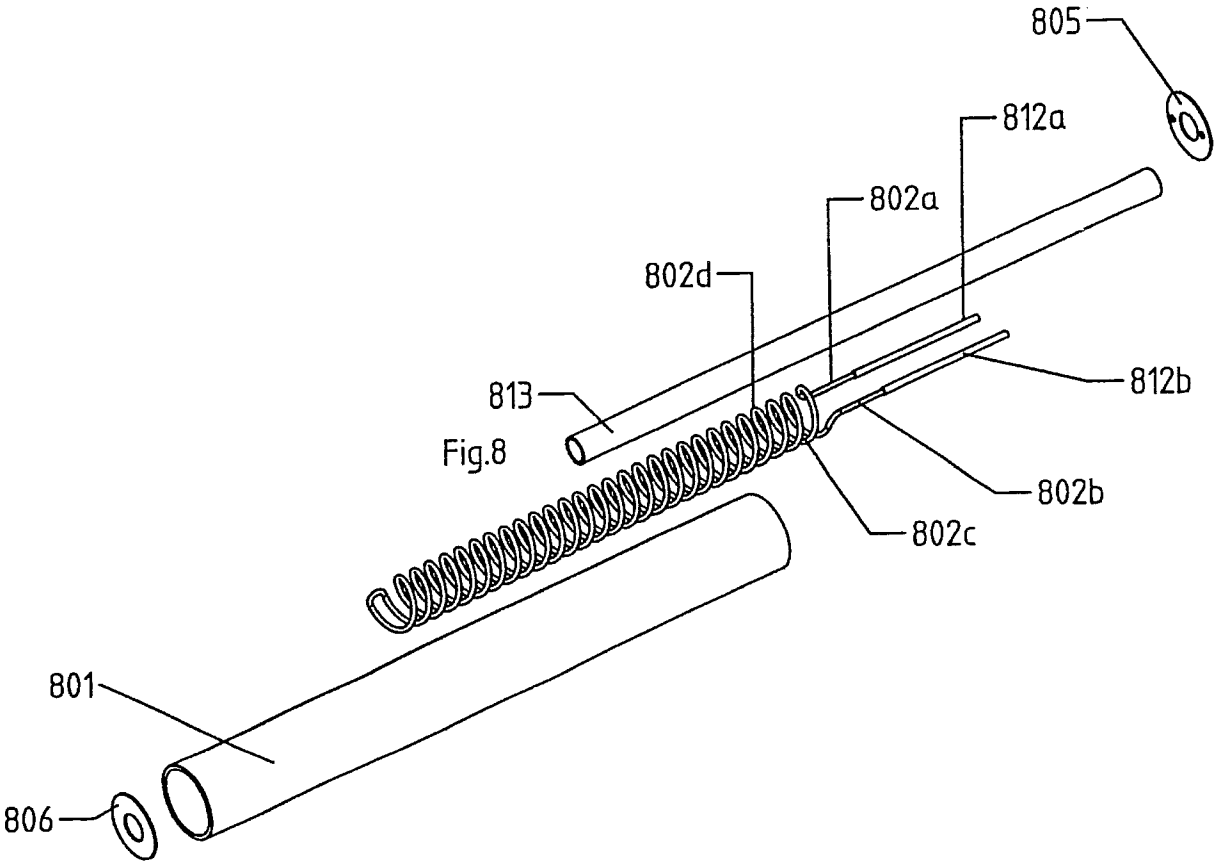
FIG. 8 is an exploded perspective view of an eighth exemplary embodiment of an electric cartridge type heater.

The exemplary embodiment of an electric cartridge type heater 800 shown in FIG. 8 as an exploded view differs from the embodiments shown in FIGS. 7*a* through 7*c* only in that no layer 714 is provided. Possible procedures in manufacturing the electric cartridge type heater 800 can easily become clear on the basis of FIG. 8. For example, the self-supporting electric resistance wire 802, which is preformed as a bifilar coil here, can be pushed over the second, inner tubular metallic jacket 813, the end-face end disk 806 can then be connected with the second tubular metallic jacket 813, and the assembly unit thus obtained can be pushed into the first, outer tubular metallic jacket 801. When filling with electric insulating material having good thermal conductivity, e.g., MgO powder, not shown in FIG. 8, the connection-side end face 805 can then be pushed over and fastened, and the entire arrangement can then be compacted radially.

However, it is also possible, as an alternative, to start with the connection of the outer metallic jacket 801 and the end-face end disk 806 and to push subsequently in the self-supporting electric resistance wire 802 preformed as a bifilar coil here. The inner tubular metallic jacket 813 is then pushed into the interior space of the self-supporting electric resistance wire 802, the space between the outer tubular metallic jacket 801 and the inner tubular metallic jacket 813 is filled with electric insulating material having good thermal conductivity, e.g., MgO powder, not shown in FIG. 8, the connection-side end face 805 is pushed over and fastened, and the entire arrangement is finally optionally compacted radially.

Figure 9A:
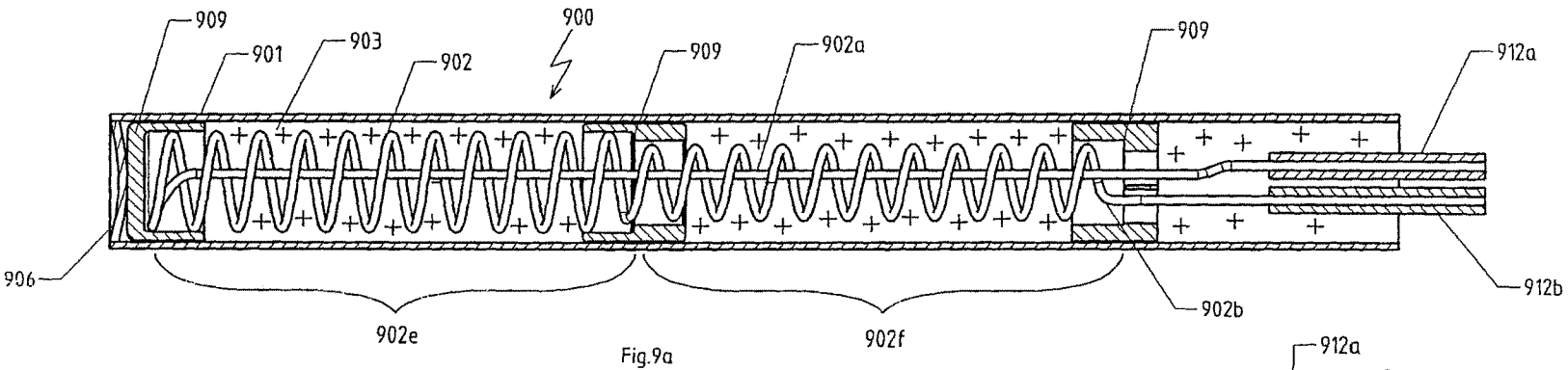
FIG. 9*a* is sectional view showing a ninth exemplary embodiment of an electric cartridge type heater, viewed in the cross section along the direction in which the electric cartridge type heater extends.
Figure 9B:
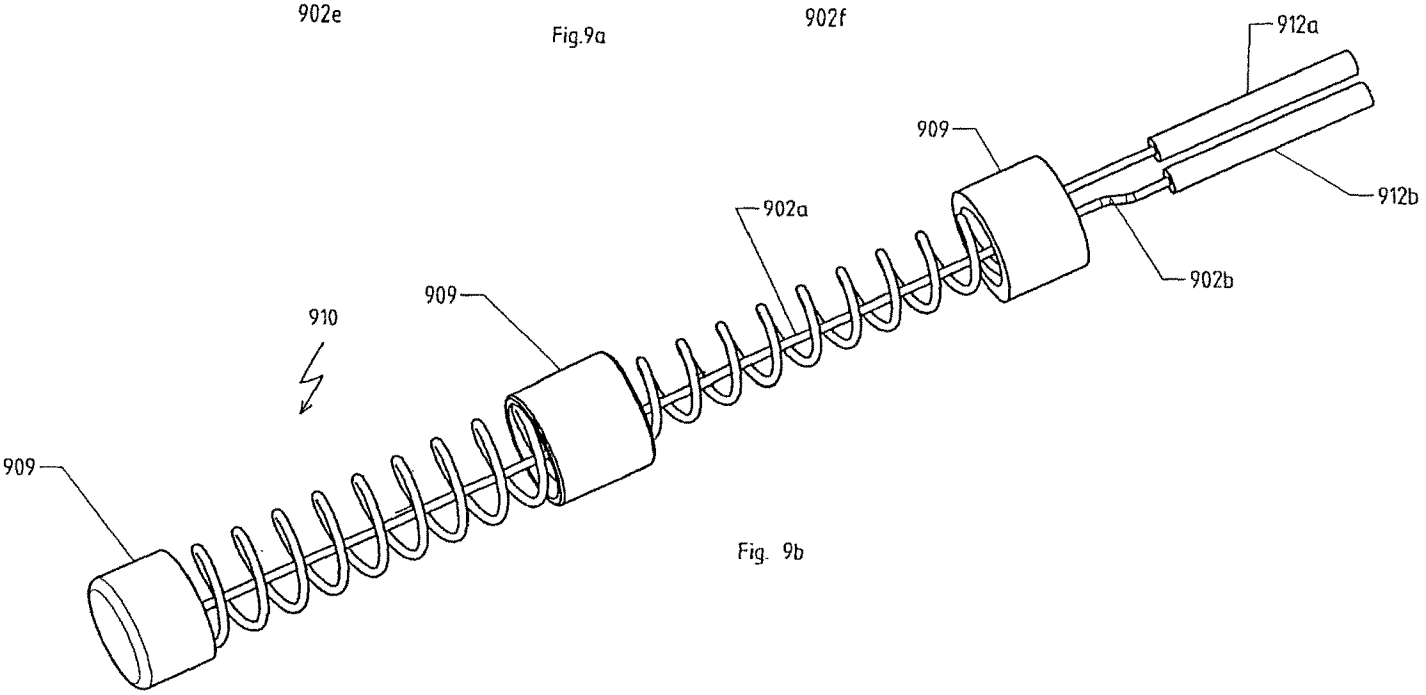
FIG. 9*b* is a perspective view showing the resistance wire assembly unit according to the exemplary embodiment shown in FIG. 9*a;*

The embodiment of an electric cartridge type heater 900 shown in FIGS. 9*a* and 9*b* is a variant of the embodiment according to FIG. 1*a*, in which areas 902*e* and 902*f* of the self-supporting electric resistance wire are provided, which have different coil diameters. It is achieved hereby, in particular, that the middle positioning element, which has a step, is fixed.

Figure 10A:
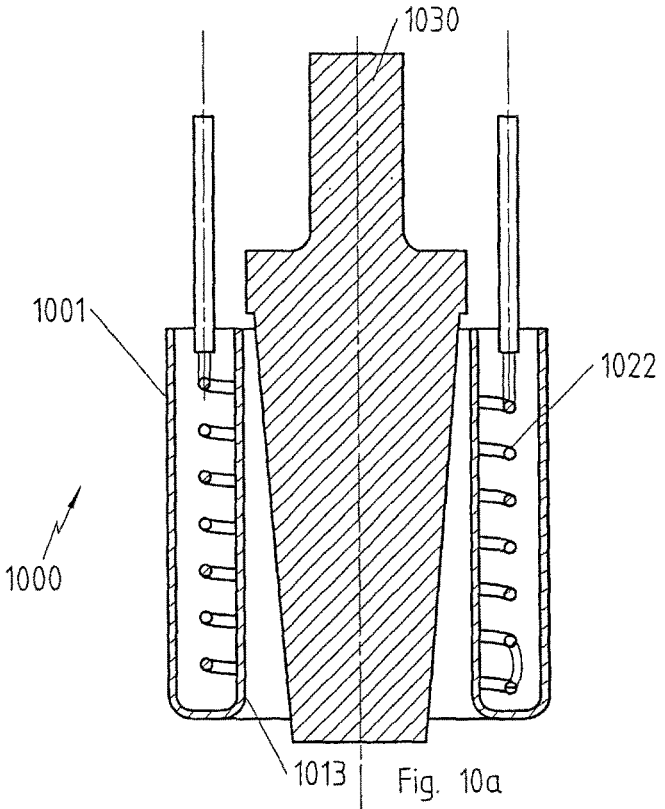
FIG. 10*a* is sectional view showing an assembly unit of an electric cartridge type heater before a compaction step.
Figure 10B:
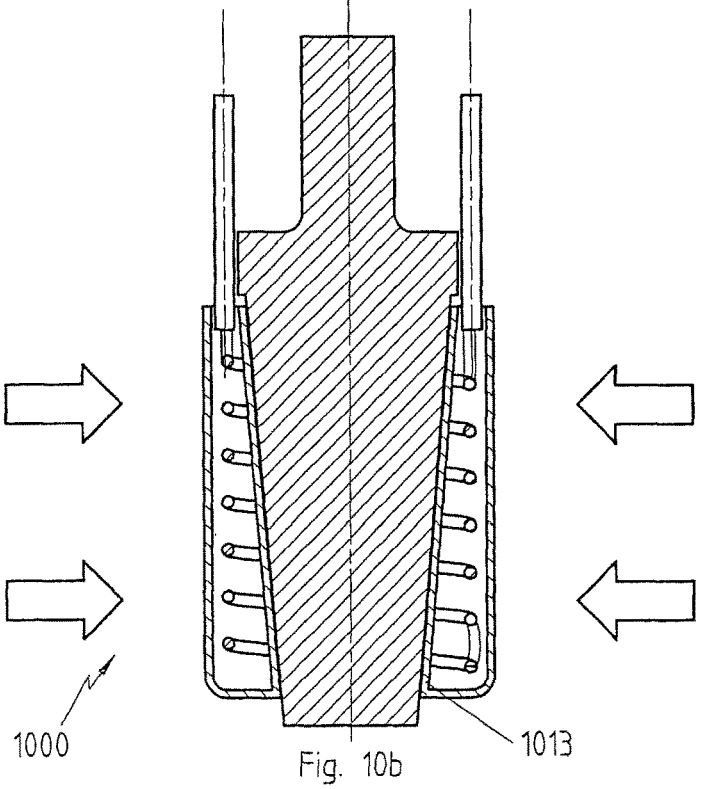
FIG. 10*b* is sectional view showing the assembly unit of an electric cartridge type heater from FIG. 10*a* after a compaction step, which leads to a conical contouring of the interior space.
Figure 10C:
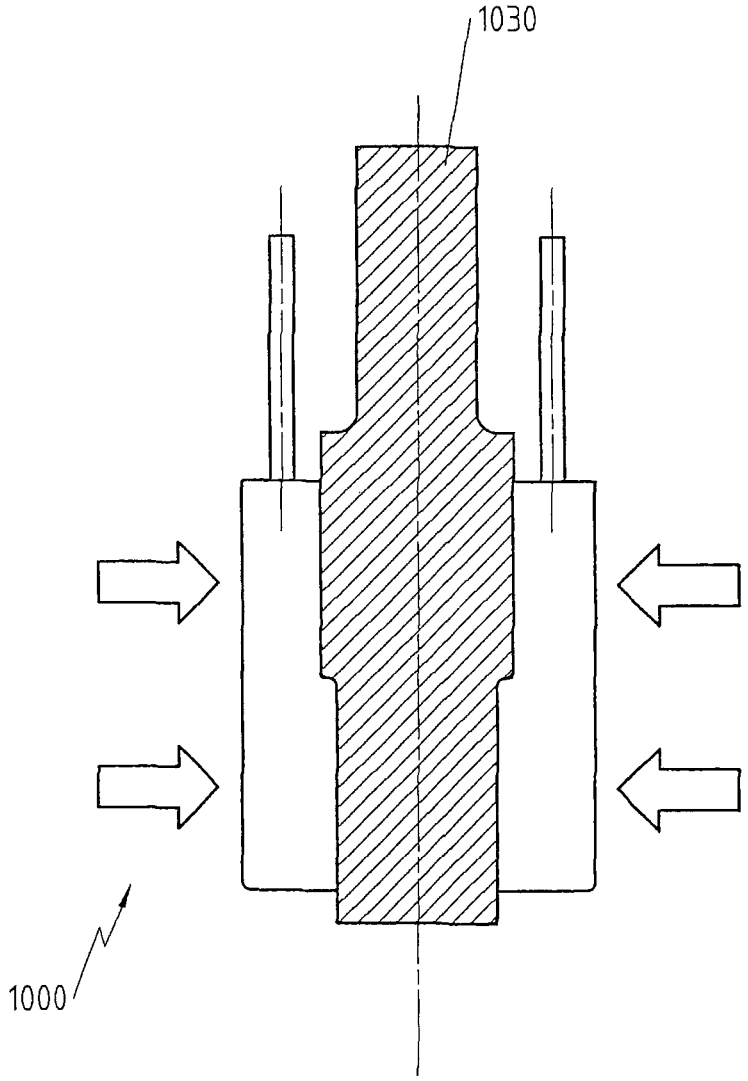
FIG. 10*c* is sectional view showing a variant of the compaction according to FIG. 10*b*, which leads to a stepped contouring of the interior space.

FIGS. 10*a* through 10*c* are intended to illustrate a possible procedure for producing an electric cartridge type heater 1000, more precisely a hollow cartridge, whose interior space 1020 has a contour. This procedure is carried out by pressing on a mandrel 1030, which has, on the one hand, the negative of the desired shape, e.g., on a conical mandrel 1030, as is shown in FIG. 10*b*, or on a stepped mandrel 1030, as is shown in FIG. 10*c*.

While specific embodiments of the invention have been shown and described in detail to illustrate the application of the principles of the invention, it will be understood that the invention may be embodied otherwise without departing from such principles.

What is claimed is:

1. An electric cartridge type heater comprising:

a tubular metallic jacket;

a self-supported resistance wire arranged in an interior of the tubular metallic jacket and having contact ends electrically contacting the resistance wire, the self-supported resistance wire comprising a resistance wire configuration, said resistance wire configuration being maintained via the self-supported resistance wire without additional mechanical stress provided from any other components of the electric cartridge type heater; and an electrically insulating material arranged in the interior of the tubular metallic jacket, wherein the resistance wire is electrically insulated from the first tubular metallic jacket by the electrically insulating material.

2. An electric cartridge type heater in accordance with claim 1, further comprising a positioning element provided in the interior of the tubular metallic jacket for a defined fixation of a position of the resistance wire, wherein the resistance wire generates heat when an electrical current passes through the resistance wire, wherein the resistance wire configuration is maintained during removal of the self-supported resistance wire from an interior of the tubular metallic jacket.

3. An electric cartridge type heater in accordance with claim 1, further comprising another tubular metallic jacket arranged concentrically to the tubular metallic jacket in the interior space thereof, so that the self-supporting resistance wire is arranged between the tubular metallic jacket and the another tubular metallic jacket.

4. An electric cartridge type heater in accordance with claim 3, wherein the another tubular metallic jacket has an interior space.

5. An electric cartridge type heater in accordance with claim 3, further comprising additional electrically insulating material having a thermal conductivity that is lower than that of the electrically insulating material between the self-supporting resistance wire and the another tubular metallic jacket, the additional electrically insulating material being arranged between the tubular metallic jacket and the self-supporting resistance wire.

6. An electric cartridge type heater in accordance with claim 1, further comprising a spacer which makes it possible to arrange the resistance wire reproducibly in the tubular metallic jacket.

7. An electric cartridge type heater in accordance with claim 1, wherein the resistance wire has a section leading away from a connection-side end face of the electric cartridge type heater and another section connected with the section in an electrically conducting manner and leading back to the connection-side end face, wherein the section and the another section of the resistance wire are designed such that they are coiled one around the other.

8. An electric cartridge type heater in accordance with claim 1, wherein the resistance wire extends in a coiled form and contact ends, electrically contacting the resistance wire, or a section of an electric connection means extend in the space enclosed by the coils to a connection-side end face of the electric cartridge type heater.

9. An electric cartridge type heater in accordance with claim 1, wherein a pitch of the resistance wire in the area formed with a smallest pitch corresponds at most to 3 times a diameter of the resistance wire.

10. An electric cartridge type heater in accordance with claim 1, wherein the self-supporting resistance wire extends in a meandering pattern.

11. An electric cartridge type heater in accordance with claim 1, wherein the contact ends electrically contacting the resistance wire point in the same direction.

12. An electric cartridge type heater in accordance with claim 1, wherein the electric cartridge type heater is compacted by a reduction of a cross section.

13. An electric cartridge type heater in accordance with claim 1, wherein a cross section of the self-supporting resistance wire has a shorter extension in a radial direction than in an axial direction.

14. An electric cartridge type heater in accordance with claim 1, further comprising:

another tubular metallic jacket, the another tubular metallic jacket being arranged concentrically to the tubular metallic jacket, within the three-dimensional curve defined by the self-supporting resistance wire, so that the another metallic jacket is surrounded by at least one section of the self-supporting resistance wire when viewed in any radial direction of the another metallic jacket, wherein an arrangement comprising at least the tubular metallic jacket, the another tubular metallic jacket and the self-supporting resistance wire is arranged on a contoured mandrel and pressed radially, so that at least the diameter of the interior space of the another tubular metallic jacket varies over the extension thereof.

15. A method for manufacturing an electric cartridge type heater, the method comprising the steps of:

providing a tubular metallic jacket;

deforming a self-supporting resistance wire, so that the resistance wire describes a preset curve in space, which curve is arranged in an interior space of the tubular metallic jacket, in a fixed position;

arranging the deformed self-supporting resistance wire in the interior space of the tubular metallic jacket, wherein a shape of the deformed self-supporting resistance wire is maintained with no mechanical stress provided by any further components of the electric cartridge type heater; and embedding the deformed self-supporting resistance wire in an electrically insulating material, so that an electric contact is prevented between sections of the preset curve in space, which curve is described by the deformed self-supporting resistance wire, and a remainder of the deformed self-supporting resistance wire and the tubular metallic jacket, wherein the shape of the deformed self-supporting resistance does not change when the deformed self-supporting resistance wire is inserted in the interior space of the tubular metallic jacket.

16. A method in accordance with claim 15, wherein the self-supporting resistance wire is coiled on a mandrel to deform the self-supporting resistance wire such that the self-support resistance wire comprises a plurality of coils, wherein a distance between each coil and an adjacent coil is maintained by the deformed self-supporting resistance wire without any mechanical stress from any further components of the electric cartridge type heater.

17. A method in accordance with claim 15, wherein a cross section of the self-supporting resistance wire is changed by pressing to reduce directions that correspond to a radial direction of the metallic jacket, after inserting the self-supporting heat resistance wire into the tubular metallic jacket, and after the deformation of the self-supporting resistance wire into the preset curve and before the deformed self-supporting resistance wire is arranged in the interior space of the tubular metallic jacket, wherein the resistance wire generates heat when an electrical current passes through the resistance wire.

18. A method in accordance with claim 15, wherein further comprising:

providing another tubular metallic jacket;

arranging the another tubular metallic jacket concentrically to the tubular metallic jacket further, within the three-dimensional curve described by the self-supporting resistance wire, so that the another metallic jacket is surrounded by at least one section of the self-supporting resistance wire when viewed in any radial direction of the another metallic jacket.

19. A method in accordance with claim 18, wherein an arrangement comprising at least the tubular metallic jacket, the another tubular metallic jacket and the self-supporting resistance wire is arranged on a contoured mandrel and pressed radially, so that at least the diameter of the interior space of the another tubular metallic jacket varies over the extension thereof.

20. An electric cartridge type heater comprising:

a tubular metallic jacket;

a self-supported resistance wire arranged in an interior of the tubular metallic jacket and having contact ends electrically contacting the resistance wire, the resistance wire comprising a plurality of coils, wherein a shape of the resistance wire and a distance between each of the coils are maintained exclusively via an internal stress of the resistance wire, whereby the shape of the resistance wire and the distance between each of the coils are maintained without additional supporting elements and a mechanical tension; and an electrically insulating material arranged in the interior of the tubular metallic jacket, wherein the resistance wire is electrically insulated from the tubular metallic jacket by the electrically insulating material.

* * * * *